US006415443B1

(12) United States Patent
Schierenbeck et al.

(10) Patent No.: US 6,415,443 B1
(45) Date of Patent: Jul. 9, 2002

(54) PROTECTIVE GLOVE

(75) Inventors: Alan W. Schierenbeck; William L. Grilliot; Mary I. Grilliot, all of Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/008,493

(22) Filed: Nov. 13, 2001

(51) Int. Cl.[7] ..... A41D 19/00
(52) U.S. Cl. ..... 2/159; 2/161.1
(58) Field of Search ..... 2/16, 20, 159, 2/161.1, 161.6, 163, 169

(56) References Cited

U.S. PATENT DOCUMENTS

| | | | | |
|---|---|---|---|---|
| 3,867,727 A | | 2/1975 | Povlacs | |
| 4,000,524 A | | 1/1977 | Rinehart | |
| 4,433,439 A | | 2/1984 | Sidman et al. | |
| 4,441,213 A | | 4/1984 | Trumble et al. | |
| 4,445,232 A | | 5/1984 | Nelson | |
| 4,454,611 A | | 6/1984 | Tschirch et al. | |
| 4,494,249 A | | 1/1985 | Hansson | |
| 4,918,756 A | | 4/1990 | Grilliot et al. | |
| 5,016,286 A | | 5/1991 | Henricksen | |
| 5,267,354 A | | 12/1993 | Grilliot et al. | |
| 5,349,705 A | | 9/1994 | Ragan | |
| 5,598,582 A | | 2/1997 | Andrews et al. | |
| 5,644,797 A | | 7/1997 | Daneshvar | |
| 5,822,796 A | | 10/1998 | Harges, Jr. et al. | |
| 5,987,646 A | * | 11/1999 | Bolmer | 2/161.1 |

* cited by examiner

*Primary Examiner*—Danny Worrell
*Assistant Examiner*—Gary L. Welch
(74) *Attorney, Agent, or Firm*—Wood, Phillips, Katz, Clark & Mortimer

(57) ABSTRACT

In a protective glove, such as a protective glove for a firefighter, a thumb-covering portion has a generally uniform width except for a tip of the thumb-covering portion, and except for a wider region where the thumb-covering portion cover's at least one knuckle of a wearer's thumb, and each finger-covering portion has a generally uniform width except for a tip of that finger-covering portion, and except for a wider region where that finger-covering portion covers at least on e knuckle of an associated finger of the wearer. The wider regions facilitate flexing without binding.

2 Claims, 1 Drawing Sheet

PROTECTIVE GLOVE

TECHNICAL FIELD OF THE INVENTION

This invention pertains to a protective glove, particularly but not exclusively an insulated glove, such as a firefighter's glove.

BACKGROUND OF THE INVENTION

As exemplified in U.S. Pat. No. 4,918,756, the disclosure of which is incorporated herein by reference, it is known to construct a firefighter's glove from plural layers, which are stitched to one another along edge seams and which include a waterproof layer, a thermally insulative layer, and an abrasion-resistant layer.

Protective gloves of related interest are exemplified in U.S. Pat. No. 4,433,439, U.S. Pat. No. 4,441,213, U.S. Pat. No. 4,445,232, and U.S. Pat. No. 4,454,611, U.S. Pat. No. 5,349,705, U.S. Pat. No. 5,598,582, U.S. Pat. No. 5,644,797, and U.S. Pat. No. 5,822,796, the disclosures of which are incorporated herein by reference.

As exemplified in U.S. Pat. No. 3,867,727, U.S. Pat. No. 4,000,524, U.S. Pat. No. 4,441,213, supra, U.S. Pat. No. 4,494,249, and U.S. Pat. No. 5,016,286, it is known to configure protective gloves in patterns that are intended to facilitate flexing of their thumb-covering and finger-covering portions.

SUMMARY OF THE INVENTION

In commonplace terms, a hand may be conveniently described as having a thumb and four fingers, the thumb having knuckles and a tip and each finger having two knuckles and a tip, as having a palm, a back, and a heel, and as having a front face and a back face. In commonplace terms, a protective glove may be conveniently described as having a front face and a back face, a thumb-covering portion, and four finger-covering portions.

When a protective glove is worn on a hand, its front face covers the palm, a front portion of the thumb, and front portions of the fingers, its back face covers the back, a back portion of the thumb, and back portions of the fingers, its thumb-covering portion covers the thumb, and each finger-covering portion covers an associated finger.

This invention contemplates that, the protective glove is configured so that, when the protective glove is not being worn but is rested on a flat surface with either face resting on the flat surface, the thumb-covering portion has a generally uniform width except for the tip of the thumb-covering portion, and except for a wider region where the thumb-covering portion covers at least one knuckle of the thumb when the protective glove is worn, and each finger portion has a generally uniform width except for the tip of said finger-covering portion, and except for a wider region where said finger-covering portion covers at least one knuckle of the associated finger when the protective glove is worn.

Preferably, when the protective glove is not being worn but is rested on a flat surface with either face resting on the flat surface, the wider region of each finger-covering portion extends approximately as far as where said finger-covering portion covers the associated finger when the protective glove is worn.

Preferably, when the protective glove is not being worn but is rested on a flat surface with either face resting on the flat surface, the protective glove has a lateral bulge where the protective glove covers the heel of the hand when the glove is worn.

When the protective glove is worn on a hand, the wider regions of the protective glove accommodate widening of the thumb, fingers, and heel of the hand, as the hand is flexed, so as to facilitate flexing of the hand without binding of the protective glove on the hand.

BRIEF DESCRIPTION OF THE DRAWINGS

In FIG. 3, as compared to FIG. 2, the finger and the finger-covering portion are flexed.

In FIG. 5, as compared to FIG. 4, the finger and the finger-covering portion are flexed.

DETAILED DESCRIPTION OF THE ILLUSTRATED EMBODIMENT

Figure 1:
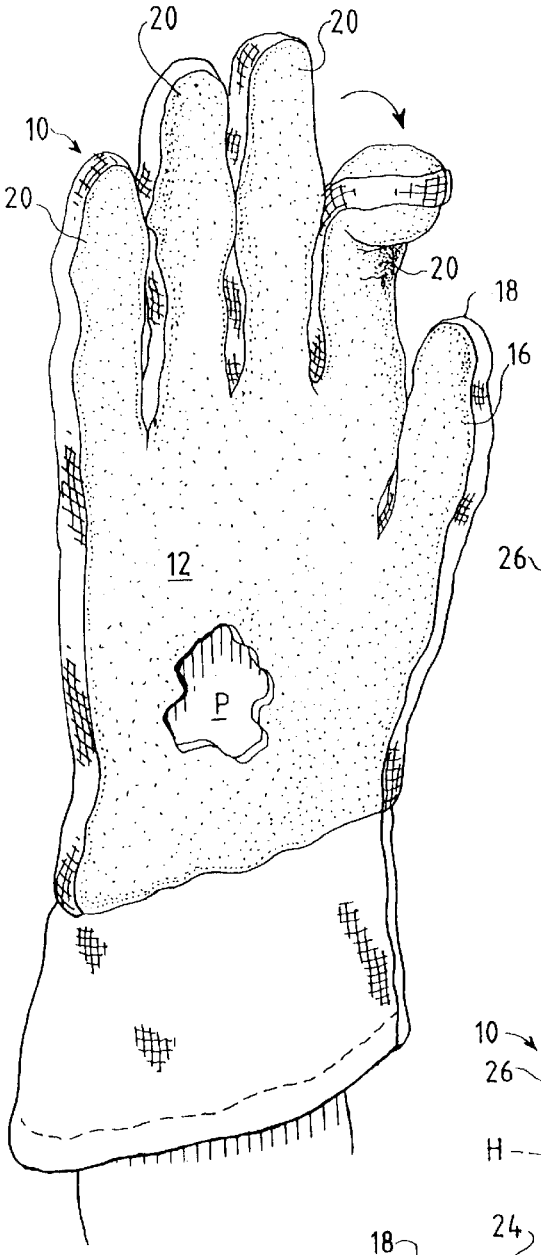
FIG. 1 is a perspective view of a protective glove embodying this invention, as seen from its front face and as worn on a hand of a wearer whose arm is shown fragmentarily below the protective glove. Being covered by the protective glove, the hand is not illustrated except in a small region, in which the protective glove is broken away to expose the palm of the hand.
Figure 4:
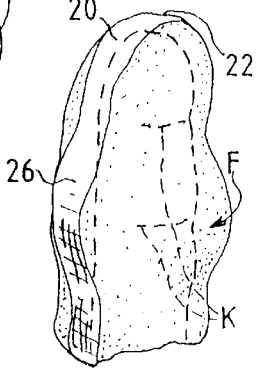
FIGS. 4 and 5 are fragmentary, perspective views of a tip on a finger-covering portion of the protective glove embodying this invention and being worn on a hand of a wearer, whose finger is illustrated fragmentarily in broken lines.
Figure 5:
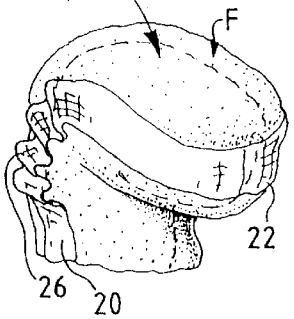
Figure 6:
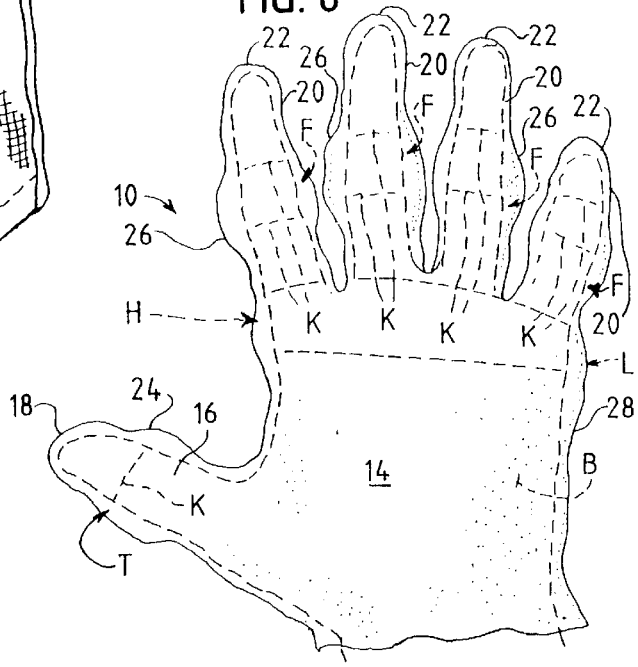
FIG. 6 is a plan view illustrating how the protective glove embodying this invention appears, as seen from its back face, when resting on a flat surface. A hand of a wearer is illustrated in an overlay, in broken lines.

As illustrated in FIG. 1 and in FIGS. 4, 5, and 6, a protective glove 10 embodying this invention has a front face 12 (see FIG. 1) which, when the protective glove 10 is worn on a hand H, covers the palm P of the hand H, a front portion of the thumb T of the hand H, and front portions of the fingers F of the hand H, and a back face 14 (see FIG. 6) which, when the protective glove 10 is worn on a hand H, covers the back B of the hand H, a back portion of the thumb T of the hand H, and back portions of the fingers F of the hand H. Moreover, the protective glove 10 has a thumb-covering portion 16, which has a tip 18 and which covers the thumb T when the protective glove 10 is worn, and four finger-covering portions 20, each of which has a tip 22 and each of which covers an associated finger F when the protective glove 10 is worn.

As exemplified in U.S. Pat. No. 4,918,756, supra, and in other patents noted above as having their disclosures incorporated herein by reference, the protective glove 10 may be a firefighter's glove constructed from plural layers, which are stitched to one another along edge seams and which include a waterproof layer, a thermally insulative layer, and an abrasion-resistant layer. Alternatively, the protective glove 10 may be a welder's glove, an electrician's glove, or a protective glove for a wearer engaged in a wide range of other activities.

As contemplated by this invention, the protective glove 10 is configured so that, when the protective glove 10 is in a condition wherein the protective glove 10 is not being worn but is rested on a flat surface with its front face 12 resting on the flat surface or, as illustrated in FIG. 6, with its back face 14 resting on the flat surface, the thumb-covering portion 16 has a generally uniform width except for its tip 18, and except for a wider region 24 where the thumb-covering portion covers at least one knuckle K of the thumb T when the protective glove 10 is worn.

As further contemplated by this invention, the protective glove 10 is configured so that, when the protective glove 10 is in the same condition, each finger-covering portion 20 has a generally uniform width except for its tip 22, and except for a wider region 26 where said finger-covering portion 20 covers at least one knuckle K of the associated finger F when the protective glove 10 is worn. The wider region 26 of each finger-covering portion 20 extends approximately as far as where said finger-covering portion 20 covers the associated finger F when the protective glove 10 is worn.

Preferably, the protective glove 10 is configured so that, when the protective glove 10 is in the same condition, the protective glove 10 has a lateral bulge 28 where the protective glove 10 covers the heel L of the hand H when the protective glove 10 is worn.

Figure 2:
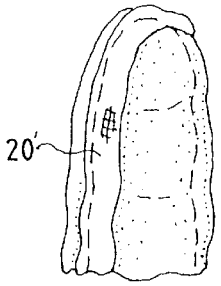
FIG. 2 PRIOR ART
FIGS. 2 and 3 are fragmentary, perspective views of a tip on a finger-covering portion of a protective glove exemplifying prior art and being worn on a hand of a wearer, whose finger is illustrated fragmentarily in broken lines.
Figure 3:
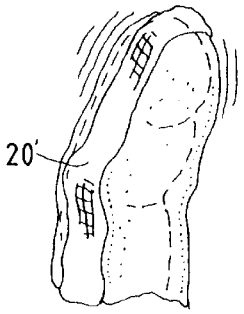
FIG. 3 PRIOR ART

When the protective glove 10 is worn on a hand, the wider region 24 of the thumb-covering portion 16, the wider regions 26 of the finger-covering portions 20, and the lateral bulge 28 buckle, as suggested in FIG. 5, to accommodate widening of the thumb T, the fingers F, and the heel L, as the hand H is flexed, so as to facilitate flexing of the hand H without binding of the protective glove 10 on the hand H. It is helpful to compare FIGS. 2 and 3, which illustrate a finger-covering portion 20' without such a widened portion.

What is claimed is:

1. A protective glove wearable on a hand, which has a thumb and four fingers, the thumb having two knuckles and a tip and each finger having two knuckles and a tip, and which has a palm, a back, and a heel, the protective glove having a front face and a back face, the front face covering the palm, a front portion of the thumb, and front portions of the fingers when the protective glove is worn, the back face covering the back, a back portion of the thumb, and back portions of the fingers when the protective glove is worn, the protective glove having a thumb-covering portion, which has a tip and which covers the thumb when the protective glove is worn, the protective glove having four finger-covering portions, each of which has a tip and each of which covers an associated finger when the protective glove is worn, wherein the protective glove is configured so that, when the protective glove is not being worn but is rested on a flat surface with either face resting on the flat surface:

(a) the thumb-covering portion has a generally uniform width except for the tip of the thumb-covering portion, and except for a wider region where the thumb-covering portion covers at least one knuckle of the thumb when the protective glove is worn; and (b) each finger-covering portion has a generally uniform width except for the tip of said finger-covering portion, and except for a wider region where said finger-covering portion covers at least one knuckle of the associated finger when the protective glove is worn; and wherein the protective glove also is configured so that, when the protective glove is not being worn but is rested on a flat surface with either face resting on the flat surface, the protective glove has a lateral bulge where the protective glove covers the heel of the hand when the protective glove is worn.

2. A protective glove wearable on a hand, which has a thumb and four fingers, the thumb having two knuckles and a tip and each finger having two knuckles and a tip, and which has a palm, a back, and a heel, the protective glove having a front face and a back face, the front face covering the palm, a front portion of the thumb, and front portions of the fingers when the protective glove is worn, the back face covering the back, a back portion of the thumb, and back portions of the fingers when the protective glove is worn, the protective glove having a thumb-covering portion, which has a tip and which covers the thumb when the protective glove is worn, the protective glove having four finger-covering portions, each of which has a tip and each of which covers an associated finger when the protective glove is worn, wherein the protective glove is configured so that, when the protective glove is not being worn but is rested on a flat surface with either face resting on the flat surface:

(a) the thumb-covering portion has a generally uniform width except for the tip of the thumb-covering portion, and except for a wider region where the thumb-covering portion covers at least one knuckle of the thumb when the protective glove is worn; and (b) each finger-covering portion has a generally uniform width except for the tip of said finger-covering portion, and except for a wider region where said finger-covering portion covers at least one knuckle of the associated finger when the protective glove is worn, wherein the wider region of said finger-covering portion extends approximately as far as where said finger-covering portion covers the associated finger when the protective glove is worn; and wherein the protective glove also is configured so that, when the protective glove is not being worn but is rested on a flat surface with either face resting on the flat surface, the protective glove has a lateral bulge where the protective glove covers the heel of the hand when the protective glove is worn.

* * * * *